US009415495B1

(12) United States Patent
Spaulding et al.

(10) Patent No.: US 9,415,495 B1
(45) Date of Patent: Aug. 16, 2016

(54) NAIL REMOVER TOOL WITH SLIDING FULCRUM AND DIMPLE

(71) Applicant: Marquette University, Milwaukee, WI (US)

(72) Inventors: Christopher Stephen Spaulding, Green Bay, WI (US); Lauren Nicole Radtke, Palatine, IL (US); Caroline Anne Villa, San Antonio, TX (US); Nathaniel Richard Larson, Siren, WI (US); Ruohao Li, Omaha, NE (US); Richard William Marklin, Jr., Wauwatosa, WI (US)

(73) Assignee: Marquette University, Milwaukee, WI (US)

( * ) Notice: Subject to any disclaimer, the term of this patent is extended or adjusted under 35 U.S.C. 154(b) by 0 days.

(21) Appl. No.: 14/798,003

(22) Filed: Jul. 13, 2015

(51) Int. Cl.
*B25C 11/00* (2006.01)

(52) U.S. Cl.
CPC ..... *B25C 11/00* (2013.01)

(58) Field of Classification Search
CPC ..... B66F 15/00; B66F 19/00
See application file for complete search history.

(56) References Cited

U.S. PATENT DOCUMENTS 1,486,820 A 3/1924 Louis
4,482,131 A 11/1984 Hamilton
5,099,724 A 3/1992 Reddy
5,141,205 A 8/1992 Iwai
5,575,029 A 11/1996 Simpson
5,657,965 A * 8/1997 Arias ..... B25C 11/02 254/28
5,695,172 A 12/1997 Hreha
5,749,113 A 5/1998 Witter
5,800,021 A 9/1998 Derr
5,896,607 A 4/1999 Hagen
6,266,834 B1 * 7/2001 Walsh ..... B25C 11/00 7/144
6,308,934 B1 10/2001 Gallo
6,519,858 B2 2/2003 Willoughby
6,578,820 B1 6/2003 Turman
6,605,576 B2 8/2003 Lee
6,629,684 B2 10/2003 Youngren
6,923,432 B1 8/2005 Martinez
7,036,952 B2 5/2006 Zirk
7,051,390 B2 5/2006 van Beek
7,252,021 B1 8/2007 Linscott
8,517,340 B2 8/2013 Pell
8,904,585 B2 12/2014 Cridlebaugh
2004/0174700 A1 9/2004 Zirk
2005/0062026 A1 3/2005 Holcomb
2005/0172415 A1 * 8/2005 Beek ..... B25F 1/00 7/146
2006/0156685 A1 7/2006 Shank
2006/0191378 A1 8/2006 Linscott
2007/0039286 A1 2/2007 DeMasi
2008/0134846 A1 6/2008 Potempa
2009/0114891 A1 * 5/2009 Metz ..... B25C 11/00 254/25
2009/0145938 A1 6/2009 Kahn
2009/0165607 A1 7/2009 Martin
2010/0038608 A1 2/2010 Degennaro
2010/0115705 A1 * 5/2010 Allen ..... B66F 15/00 7/166
2010/0263133 A1 10/2010 Langan (Continued)

*Primary Examiner* — Lee D Wilson
(74) *Attorney, Agent, or Firm* — Andrus Intellectual Property Law, LLP

(57) ABSTRACT

Disclosed is a novel nail removing tool that requires lower force to remove an embedded nail from a substrate than nail remover tools currently in use via use of a sliding fulcrum. The disclosed nail remover tool also minimizes damage to the substrate as the nail is being removed from the substrate via use of a dimple for facilitating access of the tool to a nail head.

18 Claims, 11 Drawing Sheets

(56) References Cited

U.S. PATENT DOCUMENTS

| | | | | |
|---|---|---|---|---|
| 2011/0088170 | A1 | 4/2011 | Crookston | |
| 2011/0314971 | A1 | 12/2011 | Nicosia | |
| 2012/0098282 | A1 | 4/2012 | Langan | |
| 2012/0138879 | A1 | 6/2012 | Pell | |
| 2013/0283541 | A1 | 10/2013 | Cridlebaugh | |
| 2015/0014612 | A1* | 1/2015 | Liou | B25C 11/00 254/26 R |
| 2015/0028273 | A1 | 1/2015 | Pell | |

* cited by examiner

NAIL REMOVER TOOL WITH SLIDING FULCRUM AND DIMPLE

BACKGROUND

The field of the invention relates to tools for removing embedded nails. In particular, the field of the invention relates to tools for removing an embedded nail from a substrate and minimizing damage to the substrate and embedded nail as the nail is removed so that the substrate and nail may be further repurposed or recycled.

Nail remover tools or nail pullers are known in the art. (See, e.g., U.S. Pat. Nos. 8,904,585; 8,517,340; 7,252,021; 7,051,390; 7,036,952; 6,923,432; 6,629,684; 6,605,576; 6,578,820; 6,519,858; 6,308,934; 6,266,834; 5,896,607; 5,800,021; 5,749,113; 5,575,029; 5,695,172; 5,141,205; 5,099,724; 4,482,131; 1,486,820; and U.S. Published Application Nos. 2015/0028273; 2013/0283541; 2012/0138879; 2012/0098282; 2011/0314971; 2011/0088170; 2010/0263133; 2010/0038608; 2009/0165607; 2009/0145938; 2009/0114891; 2008/0134846; 2007/0039286; 2006/0191378; 2006/0156685; 2005/0062026; 2005/0172415; and 2004/0174700; the contents of which are incorporated herein by reference in their entireties). However, many nail remover tools currently in use require a large amount of force in order to remove an embedded nail from a substrate, such as wood, and may cause unnecessary damage to the substrate and nail as the nail is removed. Nail removers that require a lower amount of force and that may be used to remove an embedded nail from a substrate while minimizing damage to the substrate and nail are desirable.

SUMMARY

Disclosed is a novel nail remover tool that requires lower force to remove an embedded nail from a substrate than nail remover tools currently in use. The disclosed nail remover tool minimizes damage to the substrate and nail as the nail is being removed from the substrate.

The disclosed nail remover tool requires lower force because the tool is structured to utilize a sliding fulcrum feature as force is applied to the tool in order to remove a nail. The disclosed nail remover also minimizes damage to the structure because the tool utilizes a dimple feature. These features and other features of the novel nail remover tool are disclosed further herein.

DETAILED DESCRIPTION

Figure 1:
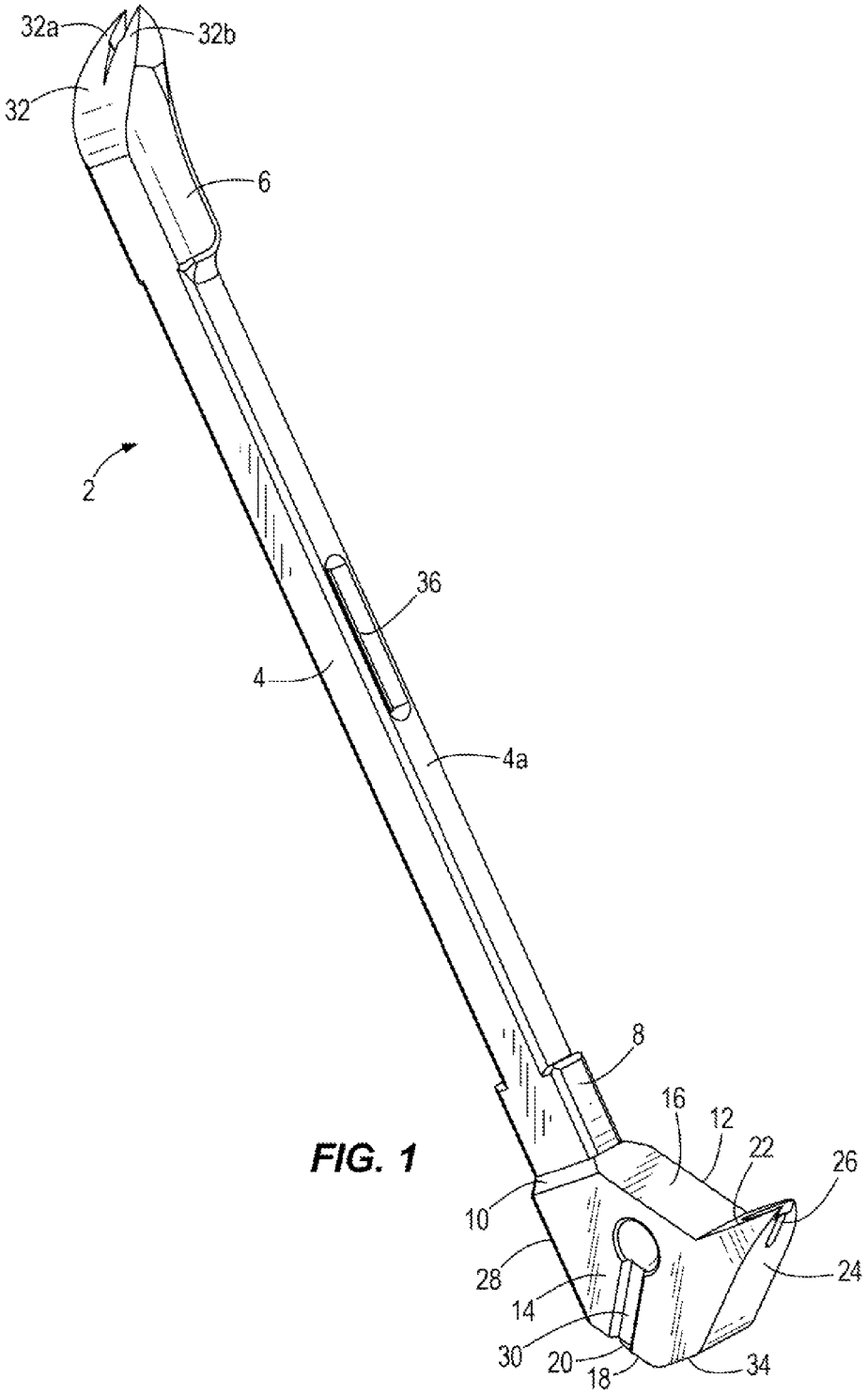
FIG. 1 illustrates a perspective view of one embodiment of a nail remover tool as contemplated herein.

The subject matter disclosed herein is described using several definitions, as set forth below and throughout the application.

Unless otherwise specified or indicated by context, the terms "a," "an," and "the," mean "one or more." For example, "a surface" should be interpreted to mean "one or more surfaces."

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus ≤10% of the particular term and "substantially" and "significantly" will mean plus or minus >10% of the particular term.

As used herein, the terms "include" and "including" have the same meaning as the terms "comprise" and "comprising." The terms "comprise" and "comprising" should be interpreted as being "open" transitional terms that permit the inclusion of additional components further to those components recited in the claims. The terms "consist" and "consisting of" should be interpreted as being "closed" transitional terms that do not permit the inclusion of additional components other than the components recited in the claims. The term "consisting essentially of" should be interpreted to be partially closed and allowing the inclusion only of additional components that do not fundamentally alter the nature of the subject matter recited in the claims.

As used herein, the phrase "nail remover tool," which may alternatively be referred to as "nail puller tool," refers to a tool utilized for removing an embedded nail from a substrate. Typically, an "embedded nail in a substrate" refers to a metal nail that has been driven into a wood or composite substrate.

The disclosed nail remover tool may be described as follows. In some embodiments, the disclosed nail remover tool may be described as including a shaft having a handle end and a head end. Typically, the handle end is utilized for grasping the tool and applying force (e.g., human pulling and/or pushing force). The head end is attached to a head that is utilized to engage and remove a nail embedded in a substrate.

The head of the tool typically includes or is defined by (a) a left side surface; (b) a right side surface; where optionally the left side surface and the right side surface are substantially parallel to each other; and (c) radial surfaces that transverse a perimeter portion of the left side surface of the head and a perimeter portion of the right side surface of the head. As such, the radial surfaces of the head are present on a radial surface of the head transversing the perimeter portion of the left side surface and the perimeter portion of the right side surface.

The radial surfaces typically include (i) a first striking surface, which preferably is substantially flat and optionally includes a hatch pattern to indicate that the surface is for striking; (ii) a dimpling surface opposite to the first striking surface, the dimpling surface comprising a dimple, such that when the first striking surface is struck, force is applied at the dimple, and the dimpling surface may be used to create an indentation in a substrate in a perimeter around the nail head of an embedded nail in order to expose the nail head and preferably the nail stem; (iii) a top claw surface and a bottom claw surface that form a toothed claw between the first striking surface and the dimpling surface; and (iv) a second striking surface opposite the toothed claw, such that when force is applied at the second striking surface, force is applied at the toothed claw to the nail.

The shaft of the tool extends linearly from the head of the tool. Typically, the shaft of the tool extends linearly in a direction from the second striking surface opposite the toothed claw. For example, a surface of the shaft and the second striking surface may be in the same plane or in parallel planes where the surface of the shaft extends linearly from the head of the tool.

The dimple of the tool is configured for creating an indentation in a substrate in which a nail has been embedded. In use, the dimple is placed over the nail head of a nail and the first striking surface is struck causing an indentation in the substrate in a perimeter around the nail head and optionally causing the nail head and preferably the nail stem to be exposed above the surface of the substrate. Exposed as such, the nail head and preferably the nail stem may be more readily engaged by the teeth of the toothed claw of the device. In order to facilitate alignment of the dimple and the nail head prior to creating the indentation, the left side surface of the head and/or the right side surface of the head may include an indication that is utilized to align the dimple and the nail head. For example, suitable alignment indications may include a groove in the left side surface of the head and/or a groove in the right side surface that is in alignment with the dimple, although any marking which may be used as an indicator of alignment may be utilized.

The dimple includes a recess for receiving a nail head and a protruding rim surrounding the dimple for creating an indentation in a substrate in which the nail has been embedded (i.e., an indentation in the substrate around a perimeter of the nail head). The dimple may be permanently attached to the head of the tool, for example, where the dimple and the head form a unitary structure. Alternatively, the dimple may be removable, for example where the dimple is screwed into a receptacle at the dimpling surface of the head of the tool, or the dimple is otherwise removably attached to the dimpling surface of the head of the tool. In some embodiments of the disclosed nail remover tools, the dimple may be removably attached to head of the tool and may be replaceable by dimples having different sized recesses, for example dimples having smaller or larger recesses for receiving smaller or larger nail heads. As such, the dimple may be gauged for use in removing particular nail heads (i.e., where a small gauge dimple is used to remove a small gauge nail) in order to minimize any damage by creating the smallest perimeter indentation about the nail head that is required for exposing the nail head.

The tool also includes a toothed claw at the head of the tool that includes two teeth with a space therebetween for receiving a nail head and nail stem. In use, after the dimple of the tool has been used to create an indentation in a substrate in which a nail is embedded and expose the nail head and nail stem, the teeth of the toothed claw may be positioned about the nail stem. Then, the second striking surface opposite the toothed claw may be struck to force the nail stem in between the space between the teeth and engage the nail head and nail stem. Optionally, the teeth may have substantially semicircular recesses on their top surfaces for receiving the nail head as the second striking surface is struck and the nail stem is forced into the space between the teeth and nail head and nail stem are engaged by the toothed claw. These semicircular recesses may be otherwise referred to as "nail grip slots" and the nail head may become seated in the nail grip slot as the nail stem and nail head are forced between the teeth of the toothed claw.

The disclosed tool typically includes a toothed claw at the head of the tool. Optionally, the disclosed tool may further include a toothed claw at the handle end of the shaft. The toothed claw at the handle end of the shaft may be configured on the tool to facilitate removal of nails that are embedded in tight spaces, such as room corners or otherwise. For example, the toothed claw at the handle end of the shaft may be in a position that is rotated about the shaft (e.g., approximately 30°, 45°, 60°, 75°, 90°, 105°, 120°, 135°, or 150°) relative to the position of the toothed claw at the head of the shaft, in order to permit the toothed claw at the handle end to be positioned around a nail in a tight space.

When the tool includes an optional toothed claw at the handle end of the shaft, the tool may include a third striking surface at the head of the device for applying force at the toothed claw at the handle end of the shaft when the third striking surface at the head of the tool is struck. The third striking surface may be located at the head of the tool between the dimpling surface and the toothed claw of the head for applying force at the toothed claw of the handle end of the shaft when the third striking surface is struck. Optionally, the third striking surface may be substantially flat and may include a hatch pattern indicating that the surface is for striking.

The optional toothed claw at the handle end of the shaft may be similarly configured as the toothed claw at the head end of the shaft. For example, the toothed claw at the handle of the shaft may include two teeth with a space therebetween for receiving a nail stem and nail head. The teeth of the toothed claw at the handle end of the shaft may be positioned on either side of the nail stem. Then, the third striking surface may be struck to force the nail stem in between the space between the teeth and engage the nail head and nail stem. Optionally, the teeth may have substantially semicircular recesses on their top surfaces for receiving the nail head as the third striking surface is struck and the nail stem is forced into the space between the teeth and the nail head and nail stem are engaged by the toothed claw at the handle end of the shaft. As discussed herein, these semicircular recesses may be otherwise referred to as "nail grip slots" and the nail head may become seated in the nail grip slot as the nail stem and nail head are forced between the teeth of the toothed claw. Force then may be applied to the tool at the head of the shaft and transmitted to the handle end of the shaft in order to remove the nail.

Optionally, the disclosed tool may include a leveling device inserted in the shaft of the tool. Suitable leveling devices may include bubble levels or spirit levels. In some embodiments, the disclosed tool is designed to sit flat and have a top surface into which the leveling device is inserted. Optionally, the disclosed tool may be designed to sit flat on one or more surfaces, including but not limited to a surface present at the head of the tool (e.g., the second striking surface), a surface of the shaft (e.g., a bottom surface opposite a top surface into which the leveling device is inserted), and a surface of the optional toothed claw at the handle of the shaft.

The disclosed tool may be utilized for removing an embedded nail in a substrate by a method that includes: (a) aligning the tool with the dimple of the tool over the nail, (b) striking the first striking surface of the head of the tool to form an indentation in the substrate and expose the nail head and/or nail stem, (c) placing the toothed claw of the head of the tool around the nail, (d) striking the second striking surface of the head of the tool (e.g., to force the nail stem into the space between the teeth and optionally to seat the nail head in the optional substantially semicircular recesses on the top surface of the teeth), and (d) applying levered force (i.e. human exertion) upwardly and then downwardly from the handle end of the shaft towards the toothed claw until the embedded nail is removed. The upwardly and downwardly human exertion force provides a force that is perpendicular to the tool shaft throughout the range of movement of the tool shaft. In mechanical terms, a force applied perpendicular to the tool shaft along with the distance to the fulcrum ($L_{effort}$) is considered the leverage of the tool. Because the dimple and the toothed claw both are placed on the radius of the head geometry (i.e., instead of on the side of the head), a user need not change his/her hand grip when using the disclosed tool (i.e., between steps (b) and (d)).

In addition to being configured to minimize damage to a substrate and a nail embedded in a substrate when the embedded nail is removed from the substrate, the disclosed tools also are configured to minimize the force required to remove the embedded nail from the substrate. As described below, the tool is configured to engage an embedded nail at an optimal angle for removing the embedded nail and to utilize a sliding fulcrum feature in order to minimize the force required to remove an embedded nail throughout all movement steps.

In the disclosed nail remover tools, the angle of the shaft when a nail is engaged by the toothed claw is an optimal angle for obtaining maximum upward force at the toothed claw when rotation force is applied upwardly at the handle end of the tool. For example, when the toothed claw engages a nail embedded in a substrate, the bottom surface of the toothed claw contacts the top surface of the substrate and the shaft of the tool extends at an angle from the head of the tool. As such, the bottom surface of the toothed claw and the shaft can be described as forming an angle $\alpha$, and preferably, in order to obtain maximum upward force at the toothed claw when rotation force is applied upwardly at the handle end of the tool, $50° < \alpha < 70°$.

In some embodiments of the disclosed nail remover tools, after the embedded nail has been engaged by the toothed claw, the tool may be used as a lever in order to remove the nail with a mechanical advantage by applying rotation force at the handle of the tool. As rotation force is applied at the handle end of the tool, the initial fulcrum of the level slides forward and increases the mechanical advantage of the level as the rotational force is applied which is discussed further below.

Figure 2:
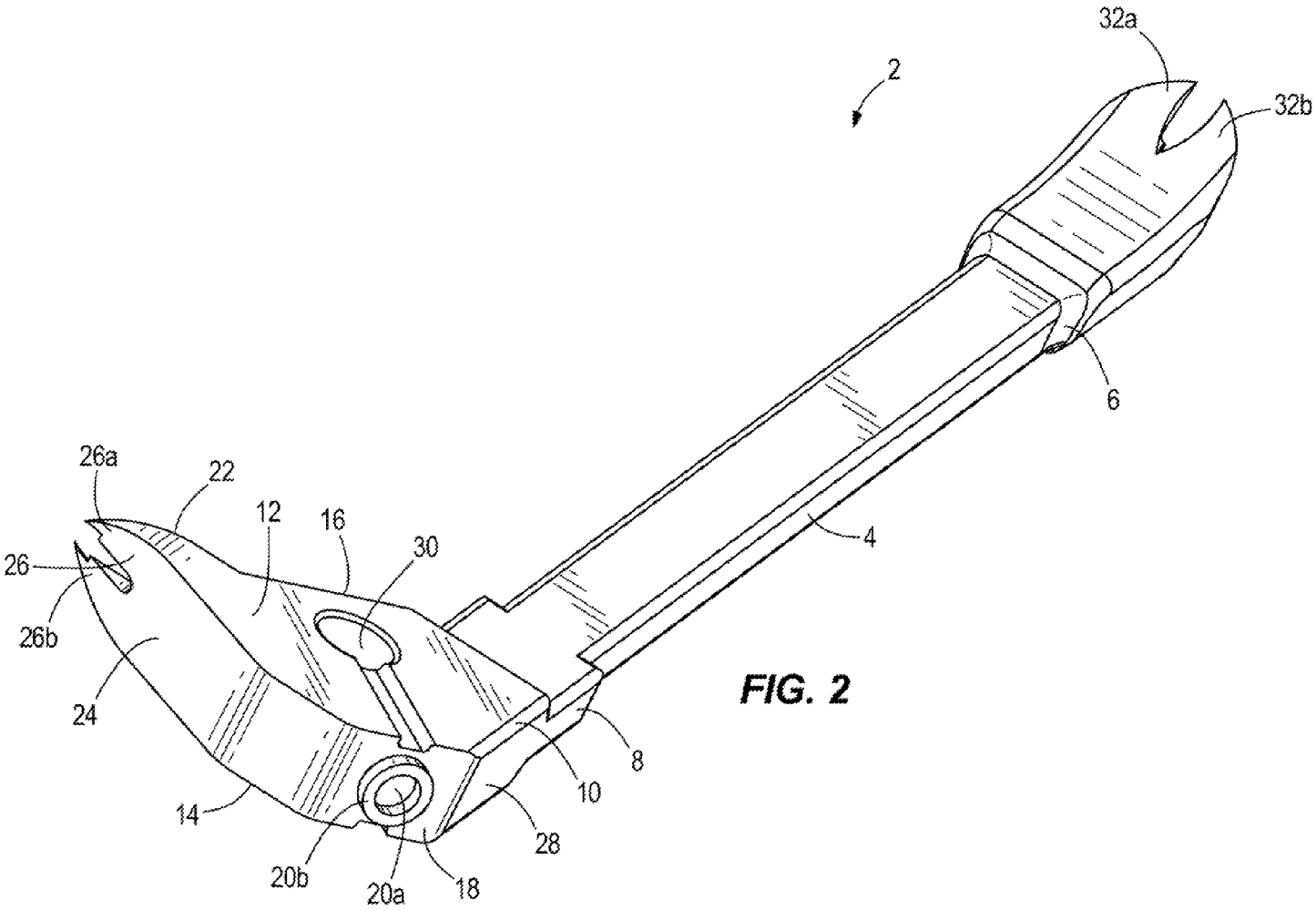
FIG. 2 illustrates another perspective view of one embodiment of a nail remover tool as contemplated herein.
Figure 4:
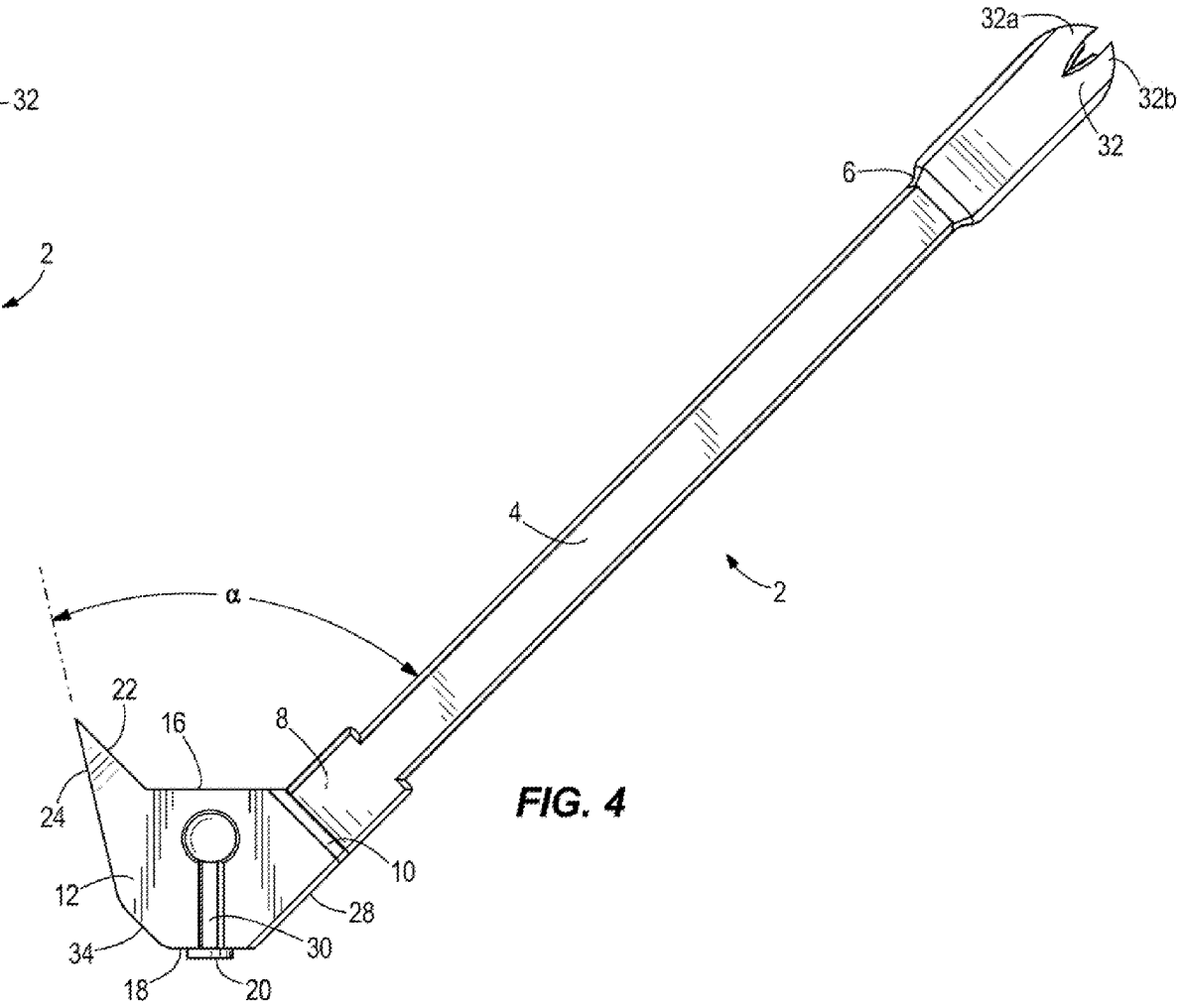
FIG. 4 illustrates a left side view of one embodiment of a nail remover tool as contemplated herein.
Figure 3:
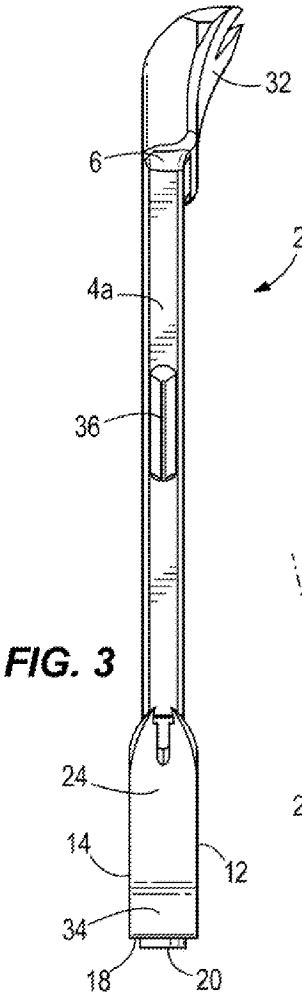
FIG. 3 illustrates a top view of one embodiment of a nail remover tool as contemplated herein.

Referring now to the figures, FIGS. 1 and 2 illustrate perspective views of embodiments of a nail remover tool 2 as contemplated herein. FIGS. 3 and 4 illustrate a top view and a left side view of embodiments of a nail remover tool 2 as contemplated herein. The tool 2 includes a shaft 4 having a handle end 6 and a head end 8, and a head 10 attached at the head end 8 of the shaft 4. The head 10 includes: (a) a left side surface 12; (b) a right side surface 14, and (c) radial surfaces that transverse a perimeter portion of the left side surface and a perimeter portion of the right side surface. The radial surfaces include: (i) a first striking surface 16, (ii) a dimpling surface 18 opposite to the first striking surface 16, the dimpling surface comprising a dimple 20; (iii) a top claw surface 22 and a bottom claw surface 24 forming a toothed claw 26 between the first striking surface 16 and the dimpling surface 18, the toothed claw having two teeth 26*a*,26*b* with a space therebetween for receiving a nail stem; and (iv) a second striking surface opposite the toothed claw 28. The shaft 4 of the tool 2 extends linearly from the second striking surface 28 opposite the toothed claw 28. As illustrated, the left side surface 12 and the right side surface 14 include a grooved indication 30 in alignment with the dimple 20 for aligning the dimple with a nail head.

As indicated in FIG. 2, the dimple 20 comprises a substantially circular recess 20*a* defined by a protruding substantially circular rim 20*b*. The recess 20*b* is configured for receiving a nail head and the protruding rim 20*a* is configured for forming an indentation around the nail head when the dimple is positioned over the nail head and the first striking surface 16 of the tool is struck.

As illustrated in FIGS. 1-4, the tool 2 further comprises a toothed claw at the handle end of the shaft 32. As illustrated, (see particularly in FIG. 3), the toothed claw at the handle end of the shaft 32 is in a position that rotated about the shaft 4 approximately 90° relative to the position of the toothed claw at the head of the shaft 26. Also as illustrated, the head of the tool 10 further comprises a third striking surface 34 between the dimpling surface 18 and the toothed claw 26 for striking and applying force at the toothed claw of the handle end of the shaft 32 when the third striking surface 34 is struck. The toothed claw of the handle end of the shaft 32 comprises two teeth 32*a*,32*b* with a space therebetween for receiving a nail stem.

As illustrated in FIGS. 1 and 3, the tool includes a leveling device 36 inserted in the shaft of the tool 4. As illustrated in FIG. 3, the leveling device 36 is inserted in the shaft 4 on a side of the shaft (i.e., the top side of the shaft 4*a*) that is opposite the second striking surface of the head 28 and the tool lays flat when the second striking surface 28 is placed downward.

The shaft of the contemplated tool may be configured to provide an optimal mechanical advantage when removing a nail. As illustrated in FIG. 4, the shaft 4 and the bottom surface of the toothed claw 24 form an angle $\alpha$, where preferably $50° < \alpha < 70°$.

Figure 5:
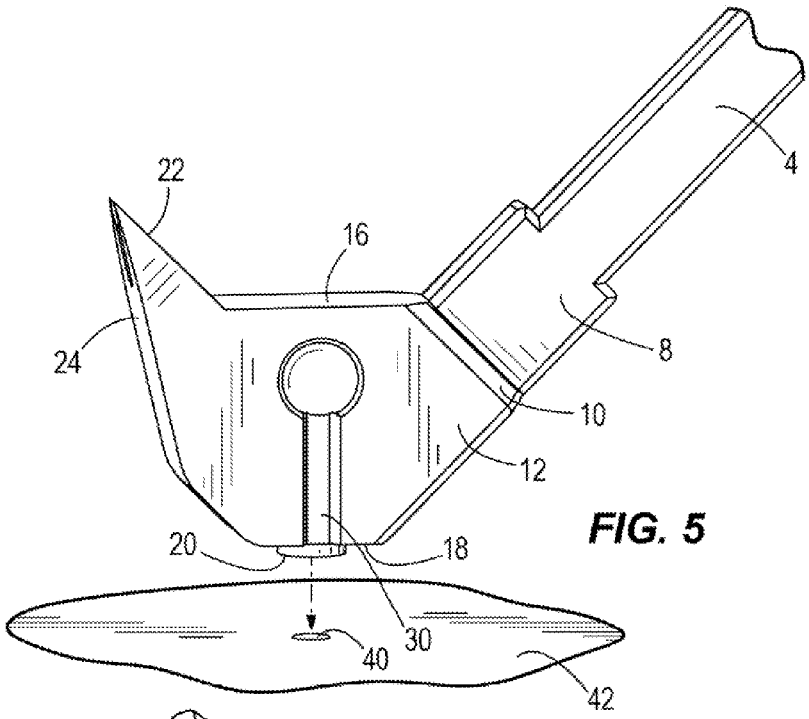
FIG. 5 illustrates a left side perspective view a nail remover tool being aligned over a nail head.
Figure 6:
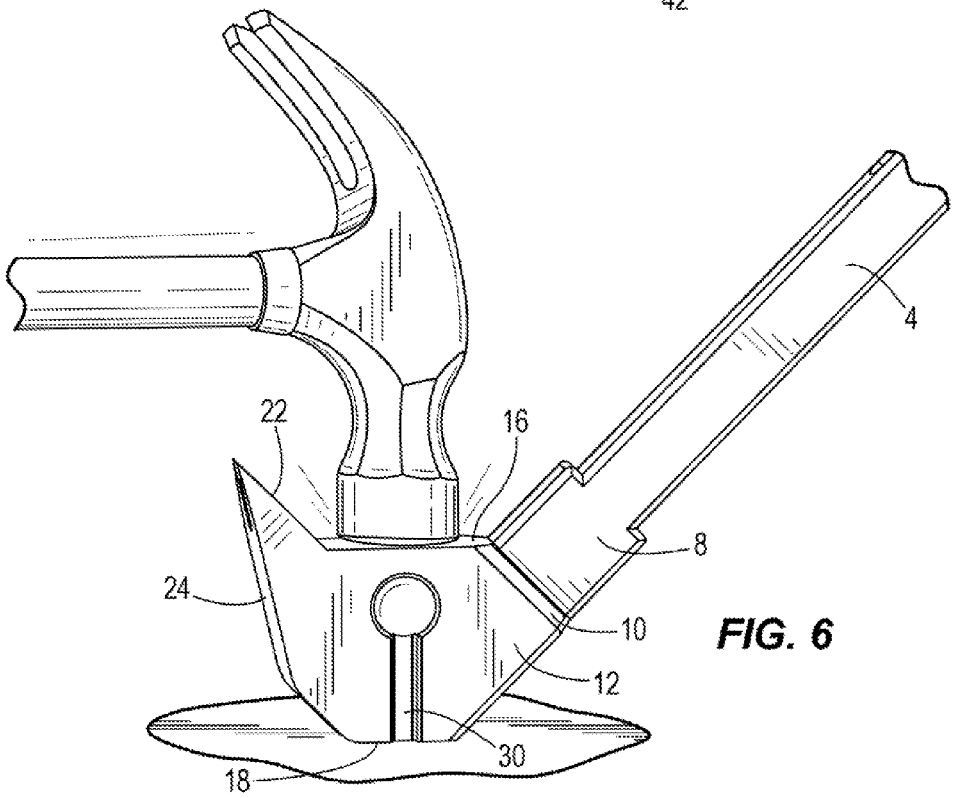
FIG. 6 illustrates a left side perspective view of the nail remover tool of FIG. 5 being used to indent a substrate around the head of a nail by applying force to the tool.
Figure 7:
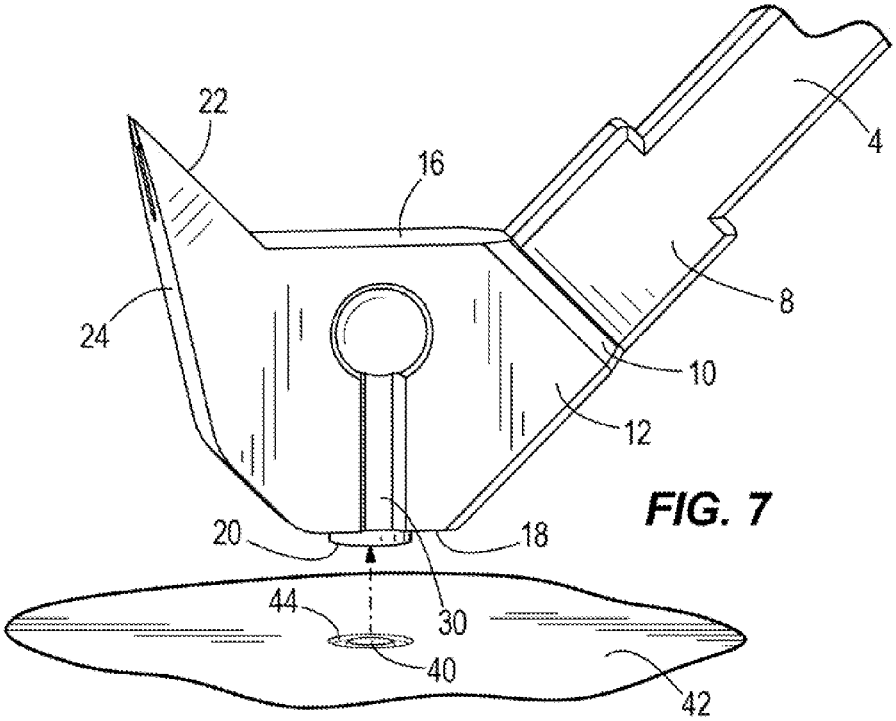
FIG. 7 illustrates a perspective view of the nail remover tool of FIG. 6 being removed after having being used to indent a substrate around the head of a nail.
Figure 8:
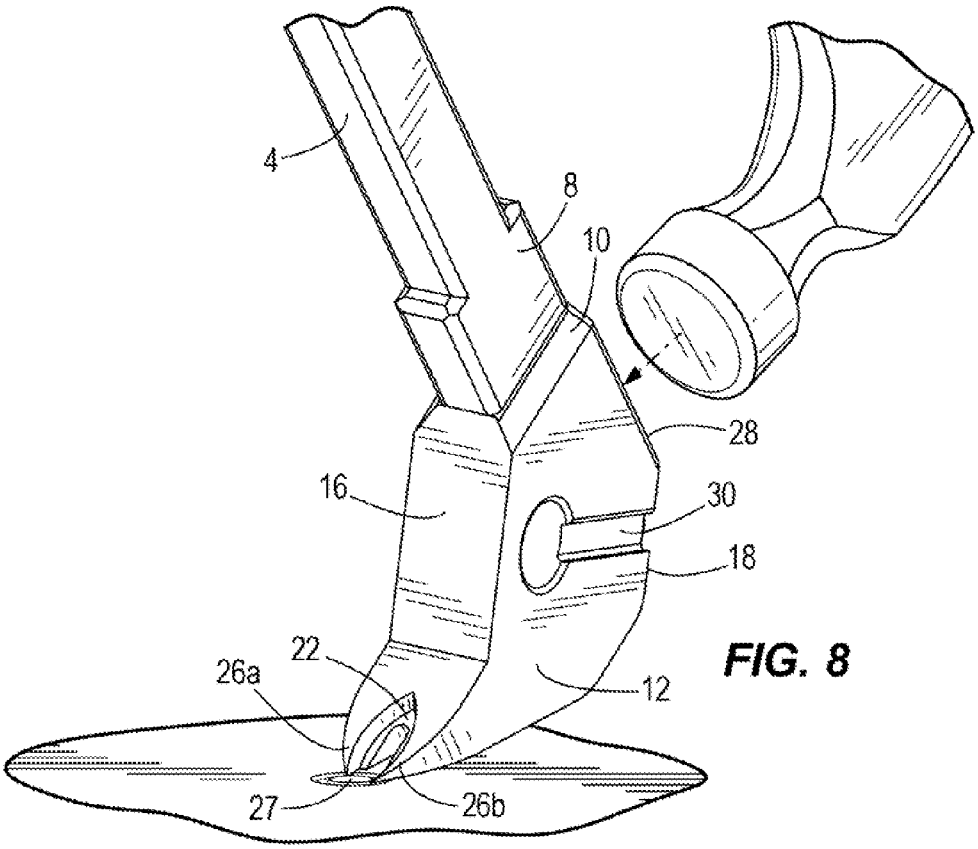
FIG. 8 illustrates a perspective view of the nail remover tool of FIG. 7 being used to engage the nail by the toothed claw of the tool via applying force to the tool.
Figure 9:
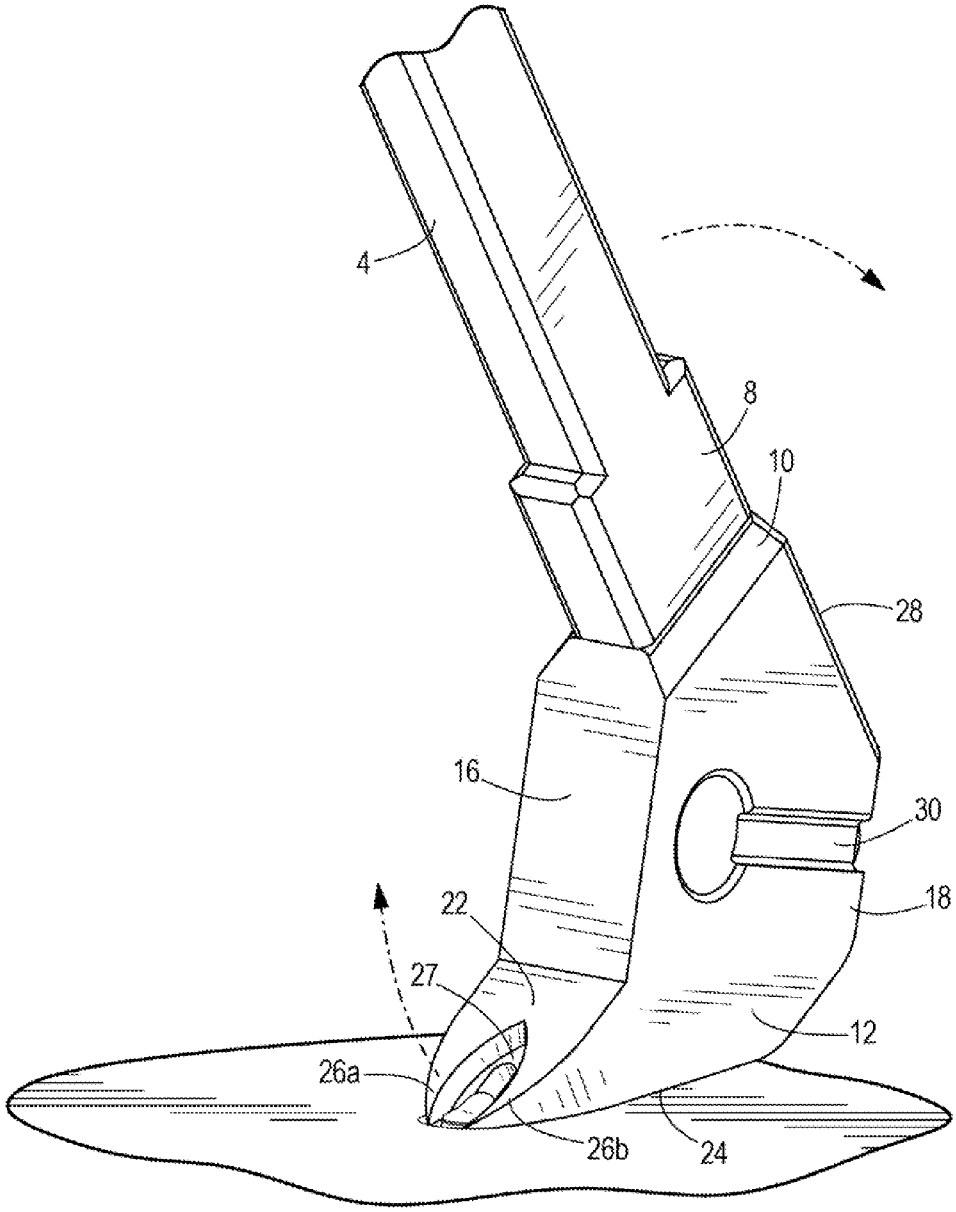
FIG. 9 illustrates a perspective view of the nail remover tool of FIG. 8 having rotational force being applied to the tool in order to remove the engaged nail.

FIGS. 5-9 illustrate embodiments of the tool in use. As illustrated in FIG. 5, the head of the tool is aligned with a nail 40 embedded in a substrate 42 via use of alignment indicator 30 to position the dimple 20 of the tool over the embedded nail 40. Next, as illustrated in FIGS. 6 and 7, the first striking surface 16 is struck to form an indentation 44 in the substrate 42 and expose the head of the nail 40 and nail stem in the substrate 42 for access by the toothed claw 26. The nail head may be above, below, or at the initial substrate surface level after the indention 44 by the dimple 20. Next, as illustrated in FIG. 8, the toothed claw of the head of the tool 26 is positioned with its teeth 26*a*,26*b* around the nail 40 and the second striking surface of the head of the tool 28 is struck to force the stem of the nail into the space between the teeth 26*a*,26*b* and to seat the nail head in the substantially semicircular recesses on the top surface of the teeth 27. Finally, as illustrated in FIG. 9, rotational force is applied upwardly then downwardly from the shaft 4 towards the toothed claw 26 until the embedded nail 40 is removed.

Figure 10:
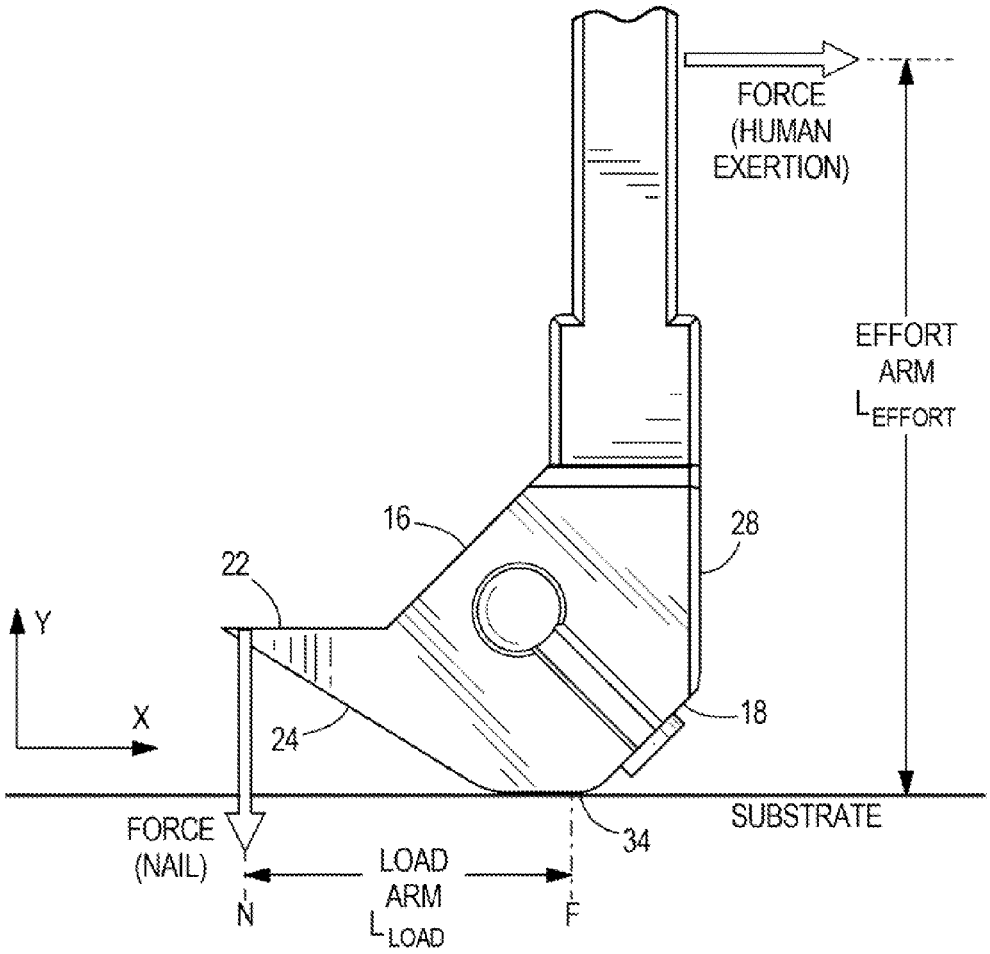
FIG. 10 illustrates the mechanics of a nail remover tool as contemplated herein including the defined effort arm, defined initial fulcrum point, and defined load arm.
Figure 11:
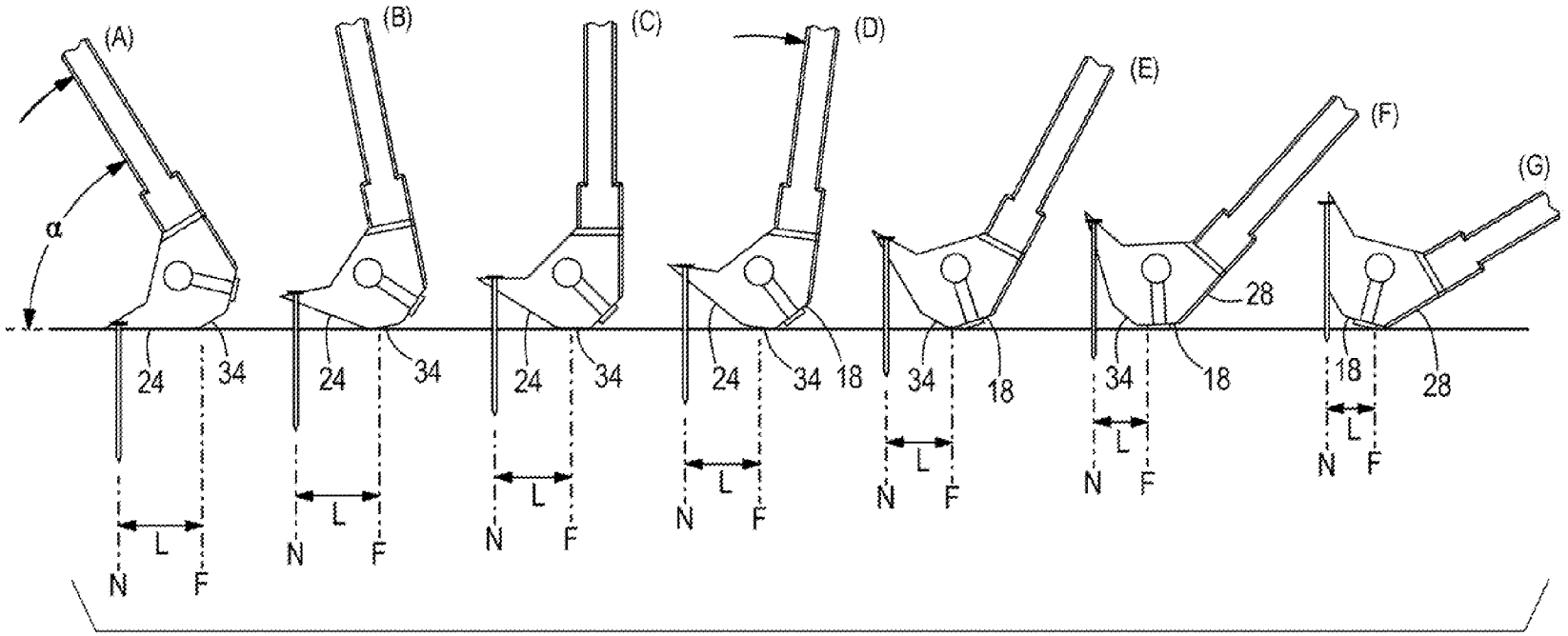
FIG. 11 provides a story board of a nail remover tool as contemplated herein being used to remove a nail and illustrates the concept of a sliding fulcrum and decreasing load arm as discussed herein.

FIGS. 10 and 11 illustrate the mechanics applied to the tool in order to remove a nail. The disclosed nail remover tool effectively may be used as a lever to remove a nail. As illustrated in FIG. 10, the length of the load arm of the lever $L_{load}$ is the distance between the nail N and the fulcrum point of the lever F. The length of the effort arm $L_{effort}$ of the lever is the distance between the point at which the force is applied at the handle end of the shaft and the fulcrum point F. The mechanical advantage given by the device in removing a nail is proportional to the length of the effort arm divided by the length of the load arm (i.e., $L_{effort}/L_{load}$).

As illustrated in FIG. 11(*a*)-(*g*), as rotation force is applied at the handle end of the shaft, first upwardly then downwardly, the initial fulcrum F slides closer to the nail N. Initially, the fulcrum F is located at the junction between the bottom claw surface 24 and the third striking surface 34. (See FIG. 11(*a*)). As rotational force is applied upwardly at the handle of the tool, the fulcrum F slides to the center of the third striking surface 34. (See Figures (b) and (c)). The tool rests upright when sitting on the third striking surface 34. (See Figure (c)). As rotational force next is applied downwardly at the handle of the tool, the fulcrum F slides to the center of the dimpling surface 18. (See Figures (d)-(f)). As the final rotation force is applied prior to the nail being removed from the substrate, the fulcrum F slides to the juncture of the dimpling surface 18 and the second striking surface 28. (See Figure (g)). The sliding motion of the fulcrum throughout these nail removing movements reduces the length of the load arm L as the rotation force is applied at the handle of the tool. (See Figures (a)-(g)). Hence, the sliding motion of the fulcrum F increases the mechanical advantage as the rotation force is applied at the handle of the tool where the mechanical advantage of the tool is proportional to $L_{effort}/L_{load}$ and $L_{load}$ decreases throughout the nail removing movements.

For nail removers currently in use which do not utilize a sliding fulcrum during the nail removing movements, the nail may become excessively bent, which damages the nail and increases the amount of force (i.e., human exertion) required to remove the nail at the end of the nail removing movement because of friction between the bent nail and the substrate. In comparison, the disclosed nail remover tool is advantageous in that as the fulcrum slides towards the nail during the nail removing movement, bending of the nail is reduced, so that damage to the nail is minimized and increased force is not required at the end of the nail removing movement to remove the nail. (See FIGS. 11(*a*)-(*g*)).

EXAMPLES

The following examples are illustrative and are not intended to limit the scope of the claimed subject matter.

We have developed a novel nail remover tool. The base head of the tool has a unique geometry and dimple feature that makes it a more ergonomic design and allows the user to remove nails from plywood, sheathing, underlayment, and other similar substrates with ease and with minimal destruction to the substrates.

The nail removal tool has at least five features that provide advantages: an ergonomic head geometry, a dimple having an advantageous location with respect to its orientation on the ergonomic head, a dimple sight alignment, nail grip slots on the teeth of the toothed claw that allow a nail head to be gripped more easily during nail removal, and a length of approximately 14.5".

The ergonomic head has a fulcrum point that allows better mechanical advantage for the user. As a user applies rotational force to the tool after engaging a nail, the fulcrum point slides forward to reduce the length of the load arm and provide an increased mechanical advantage.

On the ergonomic head, there is a dimple that fits around a nail such as an 8 or 16 penny nail and other similar fasteners that reduces the amount of damage to the surface the nail is in when compared to the common nail removers used for similar purposes. The position and orientation of the dimple on a radial surface of the head makes it possible for a user to use the dimple feature and the toothed claw feature without the user having to change hand positions to remove a nail from start to finish.

The dimple will have threads to attach to the tool's head and be able to be replaced after dulling occurs. The dimple will come in many different sizes that range in the diameter for the various nail head sizes. A common screw driver, hex key, or other hand tool may be used to remove and replace the dimple. A striking force is applied to the face of the head that is 45 degrees to the shaft that causes a displacement of the area in the surface around the nail that the face of the dimple contacts. The dimple sight alignment allows the user to visually track the position of the dimple in comparison to the nail and surface surrounding the nail.

The tool also includes a nail grip slot on the teeth of the claw head that allow a nail head to be gripped more easily. As a nail is driven between the teeth of the toothed claw of the tool, the nail head becomes seated in the nail grip slot, which makes it less likely that the nail will slip from the teeth as the nail is being removed.

Finally, the tool has a length of 14.5". Because the distance between joists and studs commonly is 16," the length of 14.5" permits the tool to fit between 16" on center joists or studs made of material (e.g., 2× wood) that is 1.5" thick.

Damage Testing and Force Testing

We tested our nail remover tool against two other nail remover tools including the Stanley Precision Claw Bar and the Vaughn Nail Puller Bar. In particular, we performed damage testing and force testing.

Figure 12:
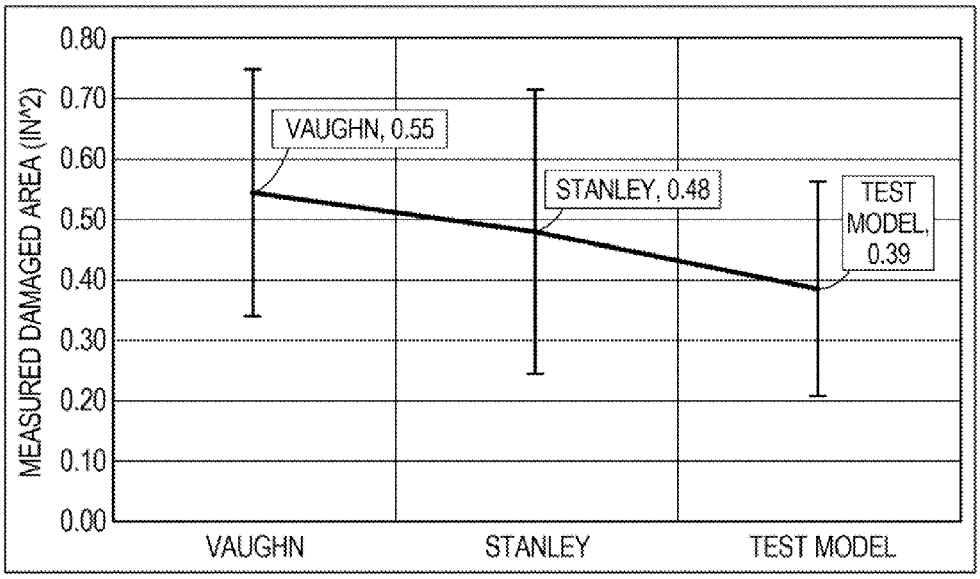
FIG. 12 illustrates average measured damage area versus nail puller type.

Damage testing was performed by painting a black 2 inch by 2 inch square around each nail. Then the three different nail removers were used to remove the nail and the results were analyzed both quantitatively and qualitatively. The quantitative results were done by having 4 people measure the area that was damaged. The data were analyzed as a two factor experiment in respect to the tool used and the person measuring. The quantitative results showed that the our tested nail remover tool caused 29% less damage than the Vaughn Nail Puller Bar and 18% less damage than the Stanley Precision Claw Bar. FIG. 12 shows the average damage area measured and the standard deviations. The ANOVA analysis showed that our tested nail remover tool was significantly different than both the Stanley Precision Claw Bar and Vaughn Nail Puller Bar ($p \leq 0.05$).

Figure 13:
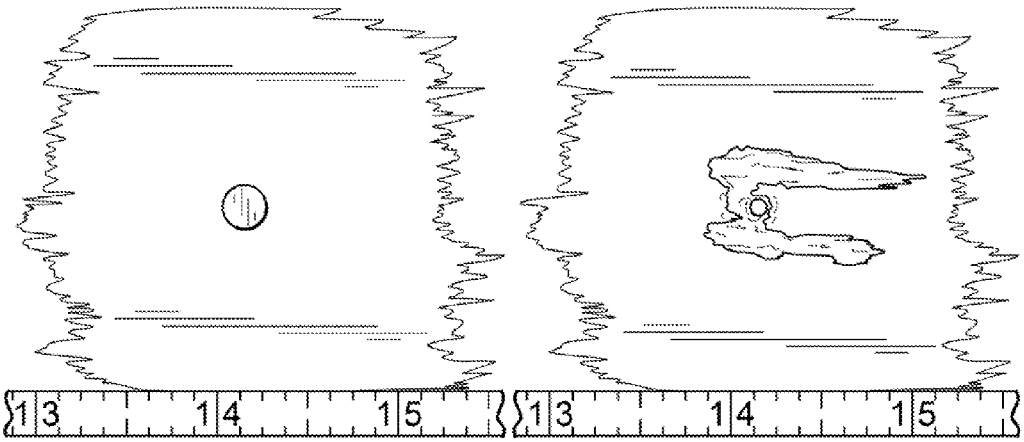
FIG. 13 illustrates before and after photos of damage cause by the Vaughn Nail Puller Bar.
Figure 14:
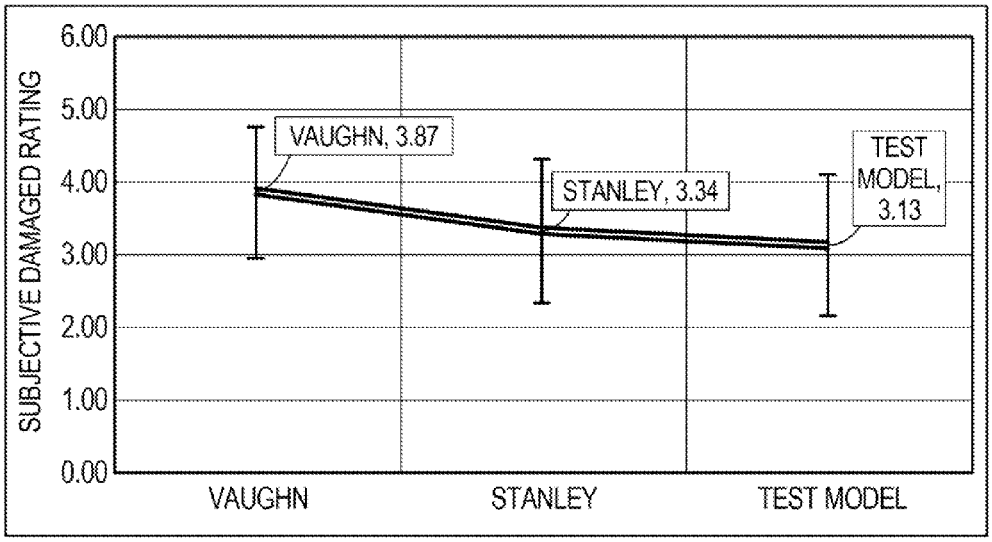
FIG. 14 illustrates average subjective damage rating versus nail puller type.

After quantitatively analyzing the damage results, we performed a survey using before and alter pictures and 41 randomly selected people from the general population. An example of the before and after picture from the survey is shown in FIG. 13 and the results of the survey are shown in FIG. 14. The ANOVA of the survey data showed that there was no visual difference of damage between our tested nail remover tool and the Stanley Precision Claw Bar ($p \geq 0.05$)

with means of 3.13 and 3.34, respectively, but there was a visual difference of damage between our tested nail remover tool and the Vaughn Nail Puller Bar ($p \leq 0.05$) with means of 3.13 and 3.87, respectively. (See FIG. 14). The data were analyzed as a two factor experiment in respect to the tool used and the surveyor.

Figure 15:
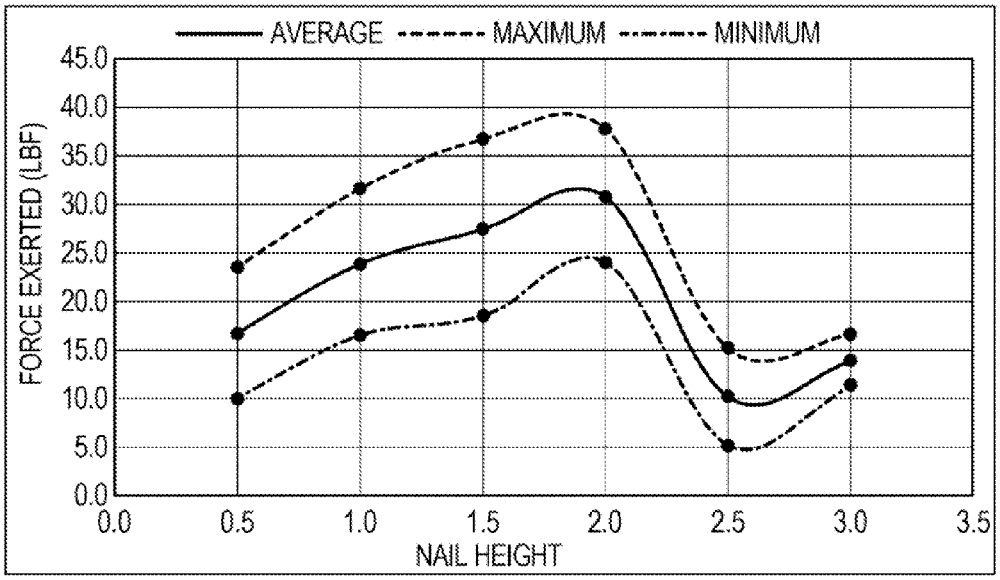
FIG. 15 illustrates average human force exertion versus nail height for the Vaughn Nail Puller Bar.
Figure 16:
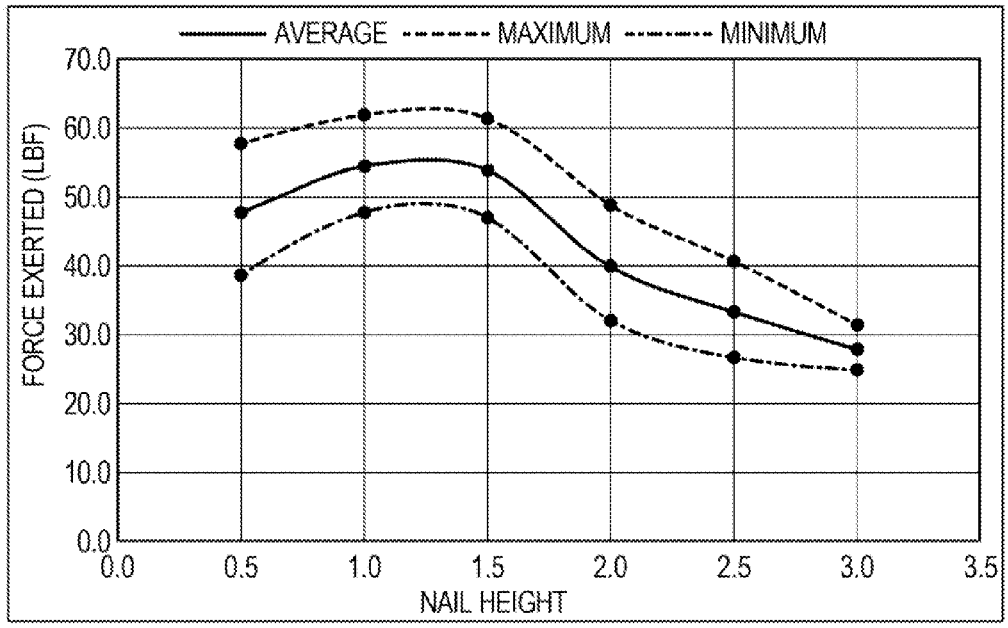
FIG. 16 illustrates average human force exertion versus nail height for the Stanley Precision Claw Bar.
Figure 17:
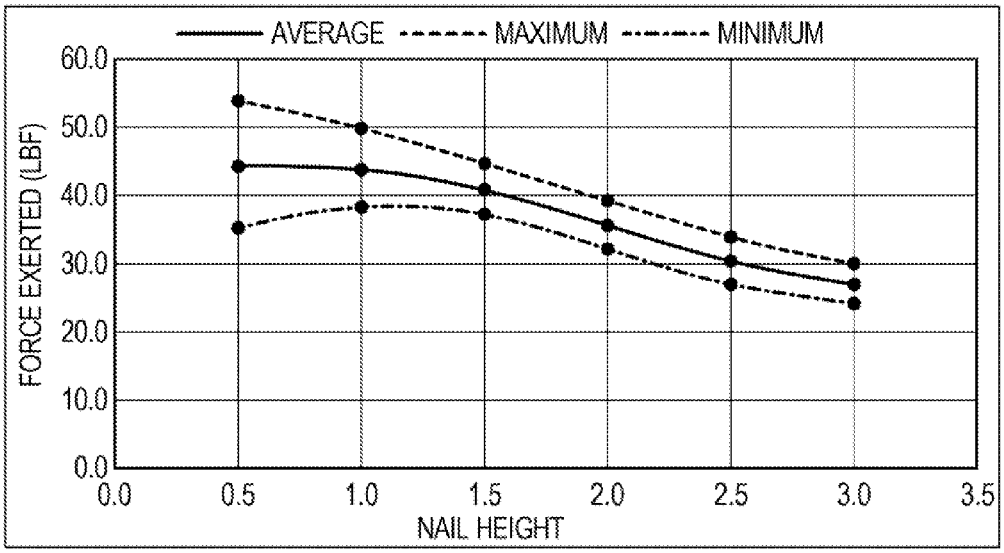
FIG. 17 illustrates average human force exertion versus nail height for our tested model nail removal tool.

Human force testing was performed by measuring the horizontal pulling force on the tools shaft throughout the entire motion of the removal process. The data were then plotted and analyzed using a one factor experimental design at each nail height that the data were taken. FIG. 15, FIG. 16, and FIG. 17 shows the data collected from the Vaughn Nail Puller Bar, Stanley Precision Claw Bar, and our tested nail remover tool respectively. The maximum and minimum values were computed using a 95% confidence interval. An ANOVA with $\alpha=0.05$ showed at an exposed nail height of 1.5" our tested nail remover tool requires 24% less force than the Stanley Precision Claw Bar with means of 40.9 lbf and 54.0 lbf respectively. These data illustrate that our tested nail remover tool requires less human force applied on the shaft of the tool in order to remove a nail.

It will be readily apparent to one skilled in the art that varying substitutions and modifications may be made to the invention disclosed herein without departing from the scope and spirit of the invention. The invention illustratively described herein suitably may be practiced in the absence of any element or elements, limitation or limitations which is not specifically disclosed herein. The terms and expressions which have been employed are used as terms of description and not of limitation, and there is no intention in the use of such terms and expressions of excluding any equivalents of the features shown and described or portions thereof, but it is recognized that various modifications are possible within the scope of the invention. Thus, it should be understood that although the present invention has been illustrated by specific embodiments and optional features, modification and/or variation of the concepts herein disclosed may be resorted to by those skilled in the art, and that such modifications and variations are considered to be within the scope of this invention.

Citations to a number of patent and non-patent references are made herein. The cited references are incorporated by reference herein in their entireties. In the event that there is an inconsistency between a definition of a term in the specification as compared to a definition of the term in a cited reference, the term should be interpreted based on the definition in the specification.

What is claimed is:

1. A nail remover tool comprising a shaft having a handle end and a head end, and a head attached at the head end of the shaft, the head comprising:

(a) a left side surface, (b) a right side surface, and (c) radial surfaces that transverse a perimeter portion of the left side surface and a perimeter portion of the right side surface, the radial surfaces comprising, (i) a first striking surface, (ii) a dimpling surface opposite to the first striking surface, the dimpling surface comprising a dimple;

(iii) a top claw surface and a bottom claw surface forming a toothed claw between the first striking surface and the dimpling surface; and (iv) a second striking surface opposite the toothed claw.

2. The tool of claim 1, wherein at least one of the left side surface and the right side surface comprises an indication in alignment with the dimple.

3. The tool of claim 1, wherein at least one of the first striking surface and the second striking surface is a substantially flat surface and comprises a hatch pattern indicating that the surface is for striking.

4. The tool of claim 1, wherein both of the first striking surface and the second striking surface are substantially flat surfaces and comprise a hatch pattern indicating that the surfaces are for striking.

5. The tool of claim 1, wherein the dimple comprises a recess defined by a protruding rim, wherein the recess is configured for receiving a nail head and the protruding rim is configured for forming an indentation around the nail head when the dimple is positioned over the nail head and the first striking surface of the tool is struck.

6. The tool of claim 5, wherein the dimple is removably attached to the head.

7. The tool of claim 6, wherein the dimple is screwed into the head and is removable and replaceable by a dimple having a protruding rim of a smaller or larger size to receive a nail head of a smaller or larger size.

8. The tool of claim 1, wherein the toothed claw comprises two teeth with a space therebetween for receiving a nail stem, the teeth comprising substantially semicircular recesses on their top surfaces for receiving a nail head.

9. The tool of claim 1, wherein the shaft and the bottom surface of the toothed claw form an angle $\alpha$ such that $50° < \alpha < 70°$.

10. The tool of claim 1, wherein the tool further comprises a toothed claw at the handle end of the shaft.

11. The tool of claim 10, wherein the toothed claw at the handle end of the shaft is in a position that is rotated about the shaft relative to the position of the toothed claw at the head of the shaft.

12. The tool of claim 10, wherein the head further comprises a third striking surface between the dimpling surface and the toothed claw of the head for applying force at the toothed claw of the handle end of the shaft when the third striking surface is struck.

13. The tool of claim 12, wherein the third striking surface is a substantially flat surface comprising a hatch pattern indicating that the surface is for striking.

14. The tool of claim 10, wherein the toothed claw of the handle end of the shaft comprises two teeth with a space therebetween for receiving a nail stem, the teeth comprising substantially semicircular recesses on their top surfaces for receiving a nail head.

15. The tool of claim 1, further comprising a leveling device inserted in the shaft of the tool.

16. The tool of claim 15, wherein the leveling device is inserted in the shaft on a side of the shaft that is opposite the second striking surface of the head and the tool lays flat when the second striking surface is placed downward.

17. The tool of claim 1, wherein the tool is approximately 14.5 inches in length.

18. A method for removing an embedded nail in a substrate, the method comprising aligning the tool of claim 1 with the dimple over the nail, striking the first striking surface of the head of the tool to form an indentation in the substrate, placing the toothed claw of the head of the tool around the nail, striking the second striking surface of the head of the tool, and applying rotational force upwardly then downwardly from the handle end of the shaft towards the toothed claw until the embedded nail is removed.

* * * * *